US005197424A

United States Patent [19]

Blum

[11] Patent Number: 5,197,424

[45] Date of Patent: Mar. 30, 1993

[54] PRE-LUBRICATION SYSTEM FOR REDUCING ENGINE WEAR

[76] Inventor: Kenneth J. Blum, 5790 NW. Ward Rd., Parkville, Mo. 64152

[21] Appl. No.: 846,629

[22] Filed: Mar. 5, 1992

[51] Int. Cl.[5] ..... F01M 5/00

[52] U.S. Cl. ..... 123/196 S; 184/6.3

[58] Field of Search ..... 123/196 R, 196 S, 179.1; 184/6.3

[56] References Cited

U.S. PATENT DOCUMENTS

| | | | |
|---|---|---|---|
| 2,747,564 | 5/1956 | Wehling | 123/196 S |
| 2,755,787 | 7/1956 | Butler | 123/196 S |
| 3,583,525 | 6/1971 | Holcomb | 123/196 S |
| 4,061,204 | 12/1977 | Kautz, Jr. | 123/196 S |
| 4,094,293 | 6/1978 | Evans | 123/196 S |
| 5,069,177 | 12/1991 | Dokonal | 123/196 S |

*Primary Examiner*—E. Rollins Cross
*Assistant Examiner*—Erick Solis
*Attorney, Agent, or Firm*—Hovey, Williams, Timmons & Collins

[57] ABSTRACT

A pre-lubrication system (14) for an internal combustion engines (10) having a pressurized lubrication system (12) is provided which serves to rapidly pre-lubricate internal engine components during an engine ignition sequence. The assembly (14) preferably includes a vessel (16) adapted to hold a charge of lubricant under positive pressure, together with a valve assembly (19) and conduit (54) coupling the vessel (16) and the engine lubrication system (12). The valve assembly (19) preferably includes a solenoid operated valve (58) and a parallel check valve (60) which cooperatively permit filling of the vessel (16) with lubricant during normal engine operation, while maintaining a pressurized charge of lubricant within the vessel (16) when the engine (10) is stopped. The solenoid valve (58) is preferably wired (80, 82) for selective and/or automatic valve opening during an ignition sequence. Opening of the valve (58) permits rapid flow of the lubricant charge from the vessel (16) into the pressurized lubrication system (12) of engine (10).

1 Claim, 1 Drawing Sheet

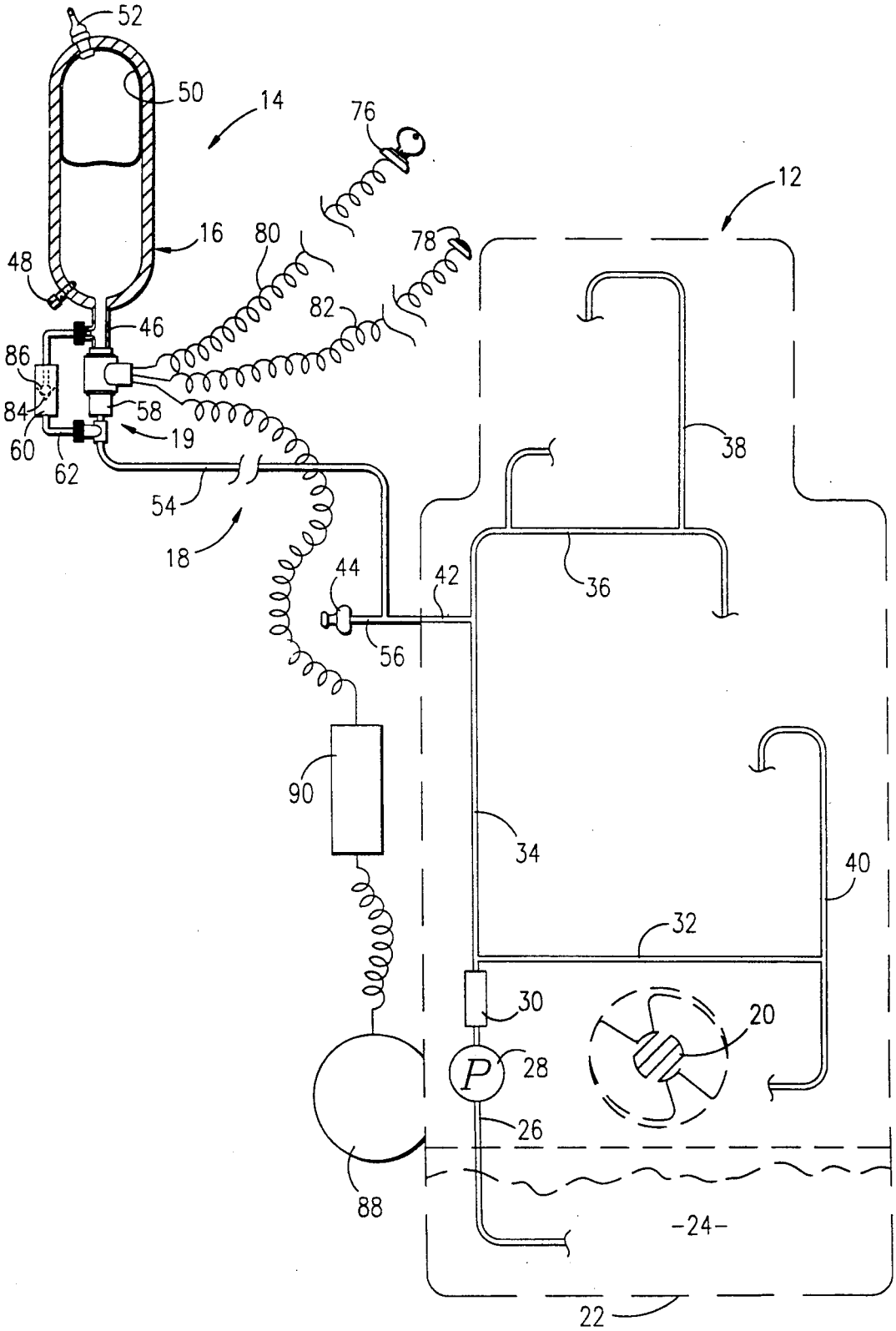
52
50
14
76
12
16
80
78
48
82
46
86
84
58
60
19
62
38
54
18
44
42
36
56
90
34
40
32
30
20
P
28
26
88
-24-
22

PRE-LUBRICATION SYSTEM FOR REDUCING ENGINE WEAR

BACKGROUND OF THE INVENTION

1. Field of the Invention

The present invention is broadly concerned with a method and apparatus for pre-lubrication of internal combustion engines in order to ameliorate the wear which occurs during ignition thereof. More particularly, it is concerned with such a pre-lubrication system having a pressurized, separate, valve-controlled oil accumulator vessel serving to lubricate vital internal engine components during an engine ignition sequence.

2. Description of the Prior Art

Modern four-stroke internal combustion engines normally have a pressurized oil circulation system for lubricating vital internal parts. These vital parts include valves, piston rings, crankshaft bearings, cam shafts, and related assemblies. The oil circulation system itself typically originates in an oil sump reservoir that is located beneath the crankshaft. The engine normally has an oil pump with an intake suction that pulls oil from a sump reservoir. The pump directs the oil first through a filter for cleaning and then through various oil galleys. The clean oil discharges from the galleys to lubricate the vital internal engine parts before returning to the sump.

If the engine operates while there is an insufficient supply of lubricating oil, the vital parts can quickly suffer premature wear from friction. For this reason, most engine designs include a pressure sensing device that is connected to the oil circulation galleys downstream of the oil pump. This pressure sensing device connects with either a gauge or a warning light in the operator's instrumentation panel.

Every one of the above-described internal combustion engines has a major flaw—a flaw that is standard in industry design. The oil pump only operates when the engine is running. Whenever an operator cranks the engine from a cold start, the vital parts move with diminished lubrication until the oil pump generates a sufficient volume and rate of flow. Experts estimate that perhaps as much as eighty percent of all engine wear occurs as a consequence of cold starting.

At least one manufacturer has attempted to address this problem. The design employed requires the installation of a second, electrically operated pump coupled with an intake line that is installed by tapping through the bottom of the sump. It is, however, disadvantageous to tap through the oil sump, because if the fitting becomes loose or is damaged then oil can drain from the lubrication system with catastrophic results. This system is also relatively expensive and difficult to install.

SUMMARY OF THE INVENTION

The present invention overcomes the problems outlined above, and provides an improved pre-lubrication assembly for use with conventional internal combustion engines equipped with pressurized lubrication systems. Broadly speaking, the assembly includes an accumulator vessel which is preferably separate from the engine and particularly the oil collection sump thereof, together with means coupling the vessel and the engine lubrication system in order that the vessel is at least partially filled with lubricant during operation of the engine and pressurized lubrication system. In addition, the assembly serves to maintain lubricant within the vessel under positive pressure when the engine operation ceases, and quickly conveys the pressurized lubricant from the vessel back to the engine's lubrication system during a subsequent engine ignition sequence.

In preferred forms, a conduit is provided between the accumulator vessel and a convenient location communicating with the pressurized lubrication system of the engine, e.g., by means of a T-fitting attached to the engine at the location where the usual pressure sending unit is attached. A valve apparatus interposed within the conduit and advantageously includes a solenoid operated valve which permits return flow of pressurized lubricant from the accumulator vessel to the engine during an engine ignition sequence, along with a parallel check valve which permits flow of lubricant from the engine to the accumulator vessel during normal engine operation.

In order to create the desirable positive pressure conditions within the accumulator vessel, use is made of a flexible bladder positioned within the vessel and which is pressurized to a convenient level.

BRIEF DESCRIPTION OF THE DRAWINGS

FIG. 1 is an essentially schematic fragmentary view illustrating an internal combustion engine having a pressurized lubrication system, with the pre-lubrication assembly of the invention operably coupled therewith; and FIG. 2 is an enlarged view in partial vertical section illustrating the construction of the solenoid valve forming a part of the pre-lubrication assembly.

DESCRIPTION OF THE PREFERRED EMBODIMENT

Turning now to the drawings, and particularly FIG. 1, an internal combustion engine 10 is schematically depicted, the latter including a pressurized lubrication system 12. A pre-lubrication assembly 14 is also illustrated, having an accumulator vessel 16, and a conduit system 18 and valve assembly 19 operably coupling the vessel 16 and lubrication system 12.

In more detail, the engine 10 is entirely conventional and includes the usual internal engine components such as crankshaft 20 and associated pistons, valves, cam shaft and bearings (not shown). The pressurized lubrication system 12 includes an lubricant crank case sump 22 holding a supply of lubricant 24. A lubricant suction line 26 having oil pump 28 and filter 30 interposed therein is located for withdrawing lubricant 24 from sump 22, and passing the lubricant through pump 28 and filter 30 for delivery to the engine components requiring lubrication. Conventional lubricant delivery galleys 32–40 coupled to line 26 downstream of filter 30 are provided for delivering such lubricant in the well known fashion. Note also that the lubrication system 12 includes a conduit 42 extending through the engine wall and adapted to communicate with a conventional oil pressure sending unit 44.

The vessel 16 is preferably completely separate from the engine 12 and sump 22. In the embodiment illustrated, the vessel 16 is in the form of an upright, thick-walled vessel designed to be supported within the engine compartment of a vehicle. The vessel 16 includes a lowermost tubular outlet 46 communicating with the interior thereof, together with a conventional drain plug 48. In addition, the vessel 16 is equipped with an inflatable internal bladder 50 formed of resilient rubberlike material. A pneumatic filling nipple 52 is operative communication with the interior of bladder 50 and extends through the wall of vessel 16 as shown.

The conduit system 18 in the form shown includes an elongated tubular lubricant-conveying conduit 54 between check assembly 19 and engine 10. Specifically, a connector tee 56 is directly coupled to engine 10 for communication with conduit 42, and the conduit 54 is secured to the upright leg of the tee as shown. The usual sender unit 44 is thereupon secured to the outboard horizontal leg of the tee fitting.

The end of conduit 54 remote from the engine 10 is coupled, via the valve assembly 19 to outlet 46 of vessel 16. The assembly 19 includes a solenoid operated valve 58 mounted in-line between outlet 46 and conduit 54. In addition, a conventional check valve 60 is interposed within a parallel flow conduit 62. The conduit 62 at its upper end communicates with outlet 46 above valve 58, and at its lower end is operatively connected and communicates with conduit 54.

The valve 58 is depicted in greater detail in FIG. 2, and includes an elongated, tubular body 64 having an upper end 66 adapted for connection with outlet 46, and a lower end 67 connected with conduit 54. Internally, the valve 58 includes a central oil passageway 68, valve seat and outlet passageway 72. A shiftable, spring-biased, solenoid-operated valve needle 74 mates with valve seat 70 and in the position depicted in FIG. 2 serves to prevent passage of lubricant through the valve 58. Electrical actuation of the valve solenoid (not shown) serves to retract the needle 74 and thereby permit flow of lubricant through the valve.

In actual practice, it is desirable to wire the valve solenoid in parallel to the vehicle ignition 76 or to a button 78 or similar manually operated switch. Such a wiring arrangement is schematically illustrated at 80, in FIG. 1. Ignition wiring as depicted would serve to initiate operation of the system 12 simultaneously with operation of the engine starter 84, whereas the button wiring allows a manual override so that the system 12 can be operated even before the engine is cranked.

The check valve 60 includes an internal seat 84 and cooperating spring-biased ball 86, and is oriented within flow conduit 62 so as to prevent flow of lubricant from vessel 16 to engine 10; it does, of course, permit flow of lubricant in the opposite direction from the engine to the vessel 16.

In the normal use of the pre-lubrication assembly 14, the bladder 50 is initially inflated to a level of perhaps 5 psi. During engine operation, lubricant is conveyed through conduits 54 and 62, and check valve 60 and outlet 46 into vessel 16 until the vessel is full and the pressurized bladder 50 prevents additional accumulation of lubricant therein. During this time, the solenoid valve 58 is closed.

When the engine 10 is shut down, valve 58 remains closed, and check valve 60 operates to prevent return flow of lubricant from the vessel 16 to the engine. As such, during the time when the engine 10 is not running, a charge of lubricant is maintained within vessel 16 under the positive pressure afforded by bladder 50.

When the operator next decides to start engine 10, he may initiate the ignition sequence by pressing button 78. This serves to open valve 58, and as a consequence the pressurized charge of lubricant within vessel 16 rapidly flows through the valve 58 and conduit 54 into the engine 10 where it serves to pre-lubricate the internal engine components. The ignition sequence can then be completed by normal starting of the engine 10, with component wear being greatly minimized by virtue of the pre-lubrication.

The preferred parallel wiring of the solenoid valve 58 insures that pre-lubrication occurs, even if the operator forgets to push the button 78. Specifically, actuation of the ignition 76 itself serves to open valve 58 and thus effect the described pre-lubrication.

It will be readily appreciated that the assembly 14 may be retrofitted to existing engines without difficulty. In such an application, the accumulator vessel 16 and attached valve assembly 19 are supported within the engine compartment, and pressure sender 44 is detached from the engine block. Tee 56 is then installed, pressure sender 44 is attached to the outboard leg of the tee, and conduit 54 (which may be a simple flexible tube) is interconnected between the valve assembly 19 and tee 56. The final step involves wiring of the solenoid valve for operation during an engine ignition sequence, preferably in the described parallel fashion.

In order to complete the installation, bladder 50 is filled to approximately 5 psi. Filling of the accumulator system with lubricant involves starting engine 10 and allowing pump 28 to direct lubricant through the conduit 54 and check valve 60 into the accumulator. Air trapped within the accumulator may be relieved as necessary by draining oil from plug 48. When the vessel 16 is filled, it is necessary that the operator refill sump 22 to its design level. For example, it is preferred that the accumulator vessel 16 have a capacity of approximately 2-½ quarts, which is one-half the normal lubricant capacity of the engine 10. Accordingly, the user would refill the crank case sump 22 with 2-½ quarts of lubricant.

When engine lubricant is changed, the lubricant is drained from sump 22 in the usual fashion, and must also be drained from the accumulator vessel 16 via plug 48. Refilling of the lubrication system of the engine 10 proceeds in the normal fashion, but again the assembly 14 must be refilled as described previously.

In preferred forms, the components of assembly 14 should be designed to withstand at least 100 psi of internal working pressure, but a 200 psi rating would normally be used to provide an adequate safety factor.

Those skilled in the art will also appreciate that the invention is subject to many possible modifications and alternatives. For example, while in the preferred form illustrated, use is made of the bladder 50 as a means of placing lubricant within the vessel 16 under positive pressure, other possibilities exist. Thus, an accumulator equipped with an internal piston or bellows could be used in lieu of the bladder. In addition, an electronic timing device can be used to automatically initiate operation of the valve 58 even before the vehicle starter is energized. In this option, the valve 58 is wired directly to the accessory terminal of the starter via an electronic device 86 (Potter & Brumfield Control No. 00742) which operates to energize the valve 58 for a preset period of up to sixty seconds, whereupon the valve is automatically de-energized until the starting cycle is initiated again. Such an option would permit the user to initiate operation of the system 12 by turning the ignition switch "on" without actually energizing the starter and cranking the engine. Thus, in extremely cold weather conditions, the user may follow this procedure and pre-lubricate the engine, even before cranking.

I claim:

1. In combination with an internal combustion engine having an engine block with structure therein defining a pressurized lubrication system for circulating lubricant therethrough, a pressure sensing device, structure for normally mounting said pressure sensing device on said block in communication with said system for monitoring the pressure conditions therein including a passageway through a wall of said block communicating with said system and receiving said sensor, an ignition switch, and a starter for cranking the engine electrically connected with said ignition switch, a pre-lubrication assembly for said engine and comprising:

an accumulator vessel including an inlet for receiving engine lubricant therein and having a bladder positioned within said vessel and filled with fluid under positive pressure, a filling nipple in operative fluid communication with said bladder and extending through the wall of said vessel for selectively charging said bladder with fluid, said bladder serving to subject engine lubricant contained in said vessel to positive pressure, said accumulator vessel further including a selectively openable drain plug for draining the contents of said vessel;

a tee fitting including first, second and third intercommunicated tubular legs, said first leg being operatively received within said engine block passageway in lieu of said sensor for communication with said system, said pressure sensor being secured to said second leg for monitoring pressure conditions within said system;

means for operably coupling said vessel and said system for at least partially filling said vessel with lubricant during operation of said pressurized lubrication system following an initial ignition sequence, for maintaining lubricant within said vessel when engine operation ceases, and for conveying lubricant from said vessel back to said system during a subsequent ignition sequence of said engine, said coupling means including a lubricant-conveying conduit operatively connected between said vessel inlet and said third tee leg, valve means interposed within said conduit for permitting selective flow of lubricant from said engine system to said vessel during engine operation, and for alternately permitting the flow of lubricant from the vessel to the system during said subsequent ignition sequence, said valve means comprising a solenoid-operated valve, there being means for operating said solenoid valve to permit said flow of lubricant from the vessel to the system during said subsequent ignition sequence, and a check valve in parallel with aid solenoid valve for permitting said flow of lubricant from said system to said vessel during operation of said engine; and an electronic timing device operably connected between said starter and said solenoid valve for opening said solenoid valve for a preselected period at the outset of said initial ignition sequence in order to deliver engine lubricant from said vessel to said engine, and for thereafter closing the solenoid valve after said preselected period has elapsed for maintaining the solenoid valve in a closed condition until a subsequent ignition sequence.

* * * * *